US010392941B2

(12) United States Patent
de Lazzer

(10) Patent No.: US 10,392,941 B2
(45) Date of Patent: Aug. 27, 2019

(54) CONTROLLED COOLING OF TURBINE SHAFTS

(71) Applicant: Siemens Aktiengesellschaft, Munich (DE)

(72) Inventor: Armin de Lazzer, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 227 days.

(21) Appl. No.: 15/517,312

(22) PCT Filed: Oct. 5, 2015

(86) PCT No.: PCT/EP2015/072911
§ 371 (c)(1),
(2) Date: Apr. 6, 2017

(87) PCT Pub. No.: WO2016/058855
PCT Pub. Date: Apr. 21, 2016

(65) Prior Publication Data
US 2017/0298738 A1 Oct. 19, 2017

(30) Foreign Application Priority Data
Oct. 15, 2014 (EP) ..... 14188998

(51) Int. Cl.
*F01D 5/08* (2006.01)

(52) U.S. Cl.
CPC ..... *F01D 5/082* (2013.01); *F01D 5/08* (2013.01); *F01D 5/081* (2013.01); *F05D 2260/201* (2013.01)

(58) Field of Classification Search
CPC . F01D 5/082; F01D 5/08; F01D 5/081; F05D 2260/201
USPC ..... 415/116
See application file for complete search history.

(56) References Cited

U.S. PATENT DOCUMENTS

| | | | |
|---|---|---|---|
| 4,571,153 | A | 2/1986 | Keller |
| 6,048,169 | A | 4/2000 | Feldmuller et al. |
| 6,102,654 | A | 8/2000 | Oeynhausen et al. |

FOREIGN PATENT DOCUMENTS

| | | | |
|---|---|---|---|
| DE | 3406071 | A1 | 8/1984 |
| EP | 0088944 | A1 | 9/1983 |
| JP | S5337210 | A | 4/1978 |
| JP | S57188702 | A | 11/1982 |
| JP | S59155503 | A | 9/1984 |

(Continued)

OTHER PUBLICATIONS

EP Search Report dated Apr. 8, 2016, for EP patent application No. 14188998.0.

(Continued)

*Primary Examiner* — Hai H Huynh
(74) *Attorney, Agent, or Firm* — Beuse Wolter Sanks & Maire

(57) ABSTRACT

A turbomachine, in particular a steam turbine, has a shield and a coolant supply which causes cold intermediate superheater steam to flow onto the rotor, wherein additionally supply holes are arranged in the shield, which holes bring part of the hot inflow steam into the cooling region between the shield and the rotor, in order to thus improve mixing so as to raise the temperature of the rotor at this thermally loaded point, such that in the event of a fault (e.g., failure of the coolant line) the resulting change in temperature is moderate.

13 Claims, 3 Drawing Sheets

(56) References Cited

FOREIGN PATENT DOCUMENTS

| | | | |
|---|---|---|---|
| JP | H04121401 | A | 10/1992 |
| WO | 9749900 | A1 | 12/1997 |

OTHER PUBLICATIONS

International Search Report dated Nov. 4, 2015, for PCT/EP2015/072911.

CONTROLLED COOLING OF TURBINE SHAFTS

CROSS REFERENCE TO RELATED APPLICATIONS

This application is the US National Stage of International Application No. PCT/EP2015/072911 filed Oct. 5, 2015, and claims the benefit thereof. The International Application claims the benefit of European Application No. EP14188998 filed Oct. 15, 2014. All of the applications are incorporated by reference herein in their entirety.

FIELD OF INVENTION

The invention relates to a turbomachine, especially to a steam turbine, having an inlet region for feeding steam, a rotatably mounted rotor, a casing which is arranged around the rotor, wherein a flow passage is formed between the rotor and the casing, wherein the flow passage and the inlet region are fluidically interconnected, having a shield which is designed in such a way that during operation steam which flows into the inlet region can be deflected into the flow passage, wherein the shield has a cooling medium feed which is designed in such a way that during operation cooling steam can flow into a cooling region which is arranged between the shield and the rotor.

BACKGROUND OF INVENTION

Turbomachines such as steam turbines are exposed to a throughflow of a flow medium which as a rule has high temperatures and pressures. Therefore, in a steam turbine as an embodiment of a turbomachine steam is used as the flow medium. The steam parameters in the live steam inlet region are high to such an extent that the steam turbine is thermally heavily stressed at various points. Therefore, for example in the inlet region of the steam turbine the materials are thermally heavily stressed. A steam turbine comprises in the main a turbine shaft, which is rotatably mounted, and also a casing which is arranged around the turbine shaft. The turbine shaft is thermally heavily stressed as a result of the temperature of the inflowing steam. It is accepted that the higher the temperature, the higher is the thermal stress. Turbine blades are arranged on the rotor in so-called slots. During operation, the slots experience a high level of mechanical stress. The thermal stress, however, lowers the tolerable mechanical stress as a result of rotation and additional loading by the blades which are fastened on the rotor.

From the thermodynamic point of view, it makes sense to raise the inlet temperature of the steam since the efficiency increases with higher inlet temperature. In order to extend the load capacity of the materials used in the steam turbine at high temperatures, the inlet regions of the shaft are cooled. Providing a suitable cooling method can be developed, changing to a higher quality, but more expensive, material can be dispensed with.

A steam turbine plant comprises at least one steam generator and a first steam turbine, which is designed as a high-pressure turbine section, and further turbine sections which are designed as an intermediate-pressure turbine section or a low-pressure turbine section. After live steam has flown through the high-pressure turbine section, the steam is heated again in a reheater to a high temperature and conducted into the intermediate-pressure turbine section. The steam which comes from the high-pressure turbine section is referred to as cold reheat steam and is comparatively cool in comparison to the live steam. This cool reheat steam is used as cooling medium.

This means that the cold reheat steam is conducted into the inlet region of the steam turbine and lowers the material temperature there. However, it is such that the cold reheat steam in the inlet region, for example in an intermediate-pressure turbine section, leads to very large temperature differences. This leads to the disadvantage that despite the cooling locally high temperature gradients, and high thermal stresses as a result thereof, occur. Furthermore, it can bring about local dimensional changes which is enforced by thermal distortion as a result of unequal thermal expansion since intensely cooled and uncooled regions are arranged next to each other. Furthermore, in the event of a cooling failure, i.e. that the cold reheat steam is not made available and therefore forms a failure case, thermal shocks occur, leading to extremely severe thermal stresses.

In the failure case, this means that in the event of a failure of the cooling the previously cooled shaft expands to a significant degree. This thermal expansion is structurally to be taken into consideration and makes the conducting of the cooling medium and sealing of the cooled region more difficult.

Document DE 34 06 071 A1 disclosed a shield, wherein the shield has only a cooling steam line but no additional line.

SUMMARY OF INVENTION

The invention starts at this point. It is the object of the invention to specify improved cooling for a steam turbine.

This object is achieved by means of a turbomachine, especially a steam turbine, having an inlet region for feeding steam, a rotatably mounted rotor, a casing which is arranged around the rotor, wherein a flow passage is formed between the rotor and the casing, wherein the flow passage and the inlet region are fluidically interconnected, having a shield which is designed in such a way that during operation steam which flows into the inlet region can be deflected into the flow passage, wherein the shield has a cooling medium feed which is designed in such a way that during operation cooling steam can flow in a cooling region which is arranged between the shield and the rotor, wherein the shield has a line which creates a fluidic connection between the cooling region and the inlet region.

The invention therefore refers to turbomachines, especially steam turbines, which comprise a shield which is arranged in the inlet region and shields the shaft from the hot flow medium. Used for the cooling is a cooling medium feed which during operation conducts cooling steam to the rotor. The invention follows the following ideas: Up to the present, a comparatively intense cooling of the rotor has been put into effect in the cooling region, i.e. between shield and rotor surface.

The rotor is cooled by a cold reheat steam which, however, leads to very intense cooling down of the rotor in the inlet region. In the event of a failure of the cooling medium, the rotor heats up in this region very intensely which leads to undesirable alternating extreme thermal stresses. In order to avoid this, it is proposed according to the invention to design the shield with a line through which the live steam can flow into the space between the rotor and the shield in addition to the cooling medium feed. The flow rate of the cooling medium and the flow rate of the live steam through the line is selected in this case in such a way that the temperature of the rotor in the inlet region is heated to a limit value. This limit value is selected in this case in such a way that in the event of a failure of the cooling medium heating up to the maximum temperature, i.e. heating up without cooling medium, is moderate.

According to the invention, it is therefore proposed to realize a passive mixed cooling, by means of holes, which can be of small design, in the shield to add a certain quantity of live steam to the cooling steam from the cooling medium feed. As a result, by suitable selection of the lines a suitable mixing temperature can be established.

A flow medium which in addition to steam can be ammonia or a steam-$CO_2$ mixture is to be understood by the term steam.

Using the invention, therefore, damage being caused by the shaft as a result of unstable malfunctioning behavior when cooling with very cold reheat steam or with costly instrumentation and control implementation in the case of temperature-controlled cooling steam is avoided. Such a new cooling arrangement is advantageous since it is passive. This means that there is no requirement for costly instrumentation and control systems and control valves for temperature control of the cooling medium. As a result of the small temperature differences in the component, a low level of thermal stress, a small additional local distortion as a result of cooling and a more robust behavior in the event of a short-term failure of the cooling are achieved.

Advantageous developments are specified in the dependent claims.

In a first advantageous development, the turbomachine is of double-flow design. This means that the shield covers a region which allows the inflowing steam to flow into a first flow and a second flow.

In one advantageous development, the cooling medium feed is designed in such a way that during operation the cooling steam impinges tangentially upon the rotor. Therefore, the cooling medium feed does not reach radially through the shield but in essence is conducted in the circumferential direction so that the cooling steam experiences a swirl into the region between the shield and the rotor.

By the same token, in an advantageous development, the line can be designed in such a way that during operation steam from the inlet region impinges tangentially upon the rotor. In this case, it is also proposed not to design the line radially through the shield but to take into consideration a tangential component which leads to a swirl of the steam from the inlet region into the space between shield and rotor.

In the case of the tangential arrangement of the cooling medium feed, a residual cooling effect as a result of the swirl-imposed inflow of live steam can be maintained in the event of failure of the cooling.

The above-described characteristics, features and advantages of this invention and also the way in which these are achieved become clearer and more distinctly comprehensible in conjunction with the following description of the exemplary embodiments which are explained in more detail in conjunction with the drawings.

Exemplary embodiments of the invention are described below with reference to the drawing. This drawing is not to definitively represent the exemplary embodiments, rather the drawing, where useful for the explanation, is implemented in schematized and/or slightly distorted form. With regard to supplements to the teachings which are directly recognizable in the drawing, reference is made to the applicable prior art.

DETAILED DESCRIPTION OF INVENTION

Figure 1:
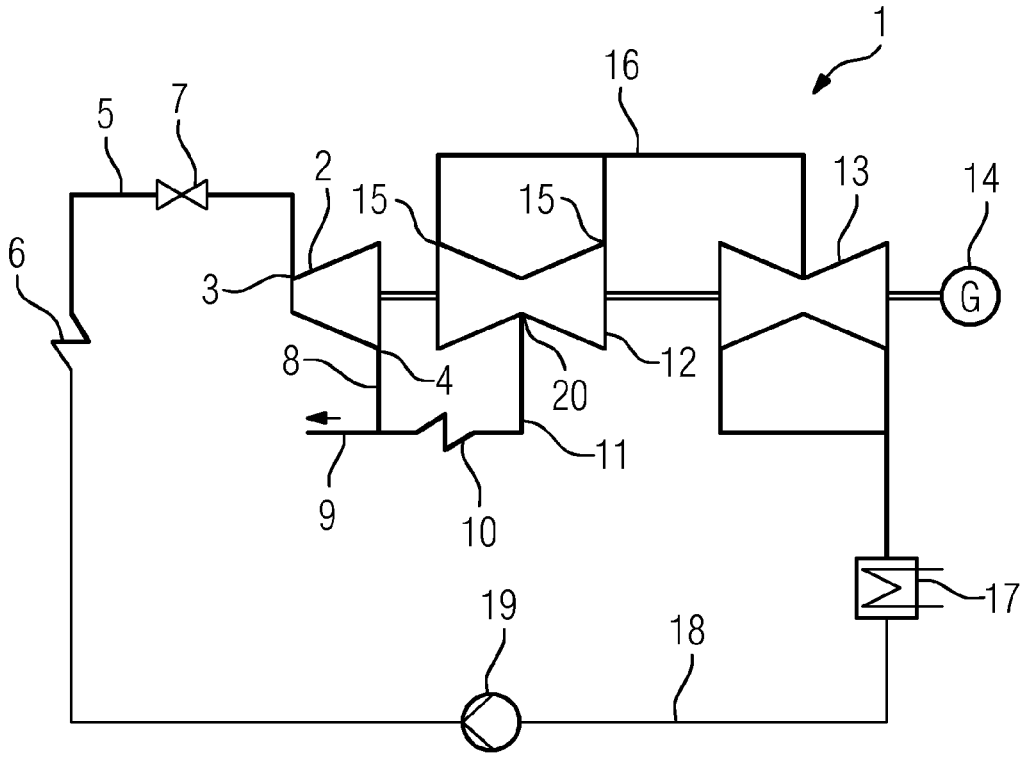
FIG. 1 shows a schematic view of a steam power plant

FIG. 1 shows a steam power plant 1 in a schematized overview. The steam power plant 1 comprises a high-pressure turbine section 2 which has a live steam feed 3 and a high-pressure steam outlet 4. Live steam from a live steam line 5 flows through the live steam feed 3, wherein the live steam was produced in a steam generator 6. Arranged in the live steam line 5 is a live steam valve 7 which controls the flow of live steam through the high-pressure turbine section 2. Also arranged in the live steam line 5 is a stop valve (not shown) which closes off the steam feed to the high-pressure turbine section 2 in the event of a failure. After steam has flown through the high-pressure turbine section 2, during which the steam in the high-pressure turbine section 2 converts the thermal energy into rotational energy of the rotor 21, the steam flows out of the high-pressure steam outlet 4 into a cold reheat line 8. The steam in the cold reheat line 8 in comparison to the steam parameters of the live steam in the live steam line 5 is such that this cold reheat steam can be used as cooling medium, which is shown schematically in FIG. 1 by means of the cooling medium line 9. The cold reheat steam is heated in a reheater 10 and via a hot reheat line 11 conducted to an intermediate-pressure turbine section 12. The cooling medium line 9 can be directed to the intermediate-pressure turbine section 12 into the inlet region (not shown). The rotor of the intermediate-pressure turbine section 12 is connected with torque transmitting effect to the rotor of the high-pressure turbine section 2 and also to the rotor 21 of a low-pressure turbine section 13. Similarly, an electric generator 14 is connected with torque transmitting effect to the rotor 21 of a low-pressure turbine section 13. After the steam has flown through the intermediate-pressure turbine section 12, the steam flows out of the intermediate-pressure steam outlets 15 to the low-pressure turbine section 13. The intermediate-pressure turbine section 12 selected in FIG. 1 comprises a first flow 29 and a second flow 30. The steam is conducted out of the intermediate-pressure steam outlets 15 in a crossover line 16 to the low-pressure turbine section 13. After flowing through the low-pressure turbine section 13, the steam flows into a condenser 17 and is condensed there, forming water. The steam which is converted in the condenser 17, forming water, then flows via a line 18 to a pump 19 and from where the water is conducted to the steam generator 6.

The high-pressure turbine section 2, the intermediate-pressure turbine section 12 and the low-pressure turbine section 13 together are referred to as a steam turbine and constitute an embodiment of a turbomachine.

Figure 2:
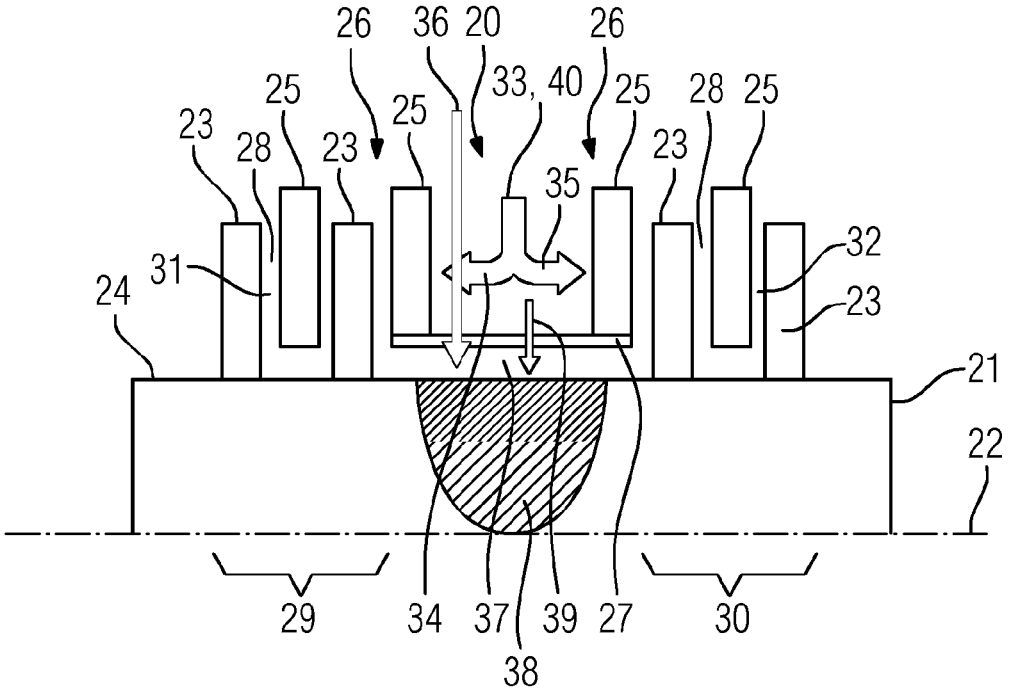
FIG. 2 shows a schematic view of the invention during operation

In FIG. 2, a view of the arrangement according to the invention is to be seen. FIG. 2 shows in particular an inlet region 20 of the intermediate-pressure turbine section 12. The intermediate-pressure turbine section 12 comprises a rotor 21 which is rotatably mounted around a rotational axis 22. The rotor 21 comprises a plurality of rotor blades 23 which are arranged in slots (not shown) on the rotor surface 24. Arranged between the rotor blades 23 are stator blades 25 which are retained on a casing (not shown). A first stator blade row 26 is designed in such a way that this stator blade row 26 supports a shield 27. The shield 27 is designed in such a way that during operation steam which flows into the inlet region 20 can be deflected into a flow passage 28. Since the intermediate-pressure turbine section 12 shown in FIG. 2 has a first flow 29 and a second flow 30, the flow passage 28 is divided into a first flow passage 31 and a second flow passage 32. The inflowing steam 33 is therefore deflected forming a first steam 34 and a second steam 35. The first steam 34 flows into the first flow passage 31. The second steam 35 flows into the second flow passage 32.

The intermediate-pressure turbine section 12 comprises a casing (not shown) which is arranged around the rotor 21, wherein the first flow passage 31 and the second flow passage 32 are formed between the rotor 21 and the casing, wherein the first flow passage 31 and the second flow passage 32 are fluidically connected to the inflow region 20.

A flow medium which in addition to steam can be ammonia or a steam-$CO_2$ mixture is to be understood by the term steam.

The shield 27 has a cooling medium feed 36 which is designed in such a way that during operation cooling steam flows into a cooling region 37 which is arranged between the shield 27 and the rotor 21. Used as cooling steam is steam from the cooling medium line 9 which comes from the cold reheat line 8. Other cooling steam can be used in alternative embodiments. The cooling steam therefore flows out the cooling medium feed 36 onto the rotor surface 24 and cools a thermally stressed region which is represented by means of a parabolic gray area 38. The temperature is represented in shades of gray. As is to be seen in FIG. 2, the shade of gray in the parabolic gray area 38 is a little darker than the shades of gray of the rotor 21. This means that the temperature in the parabolic gray area 38 is higher than the temperature of the rotor 21.

In addition to the cooling medium feed 36, a line 39 is now arranged according to the invention in the shield 27. This line 39 creates a fluidic connection between the cooling region 37 and the inlet region 20. The line 39 can be constructed as a hole or as a plurality of holes. These holes can be constructed in a distributed manner on the circumference. The line 39 can be arranged symmetrically to the parabolic gray area 38, which means that the line 39 is arranged in the direction of a central inflow direction 40. In FIG. 2, the line 39 is not shown in the same direction as the central inflow direction 40 but shown a small distance further to the right.

Figure 3:
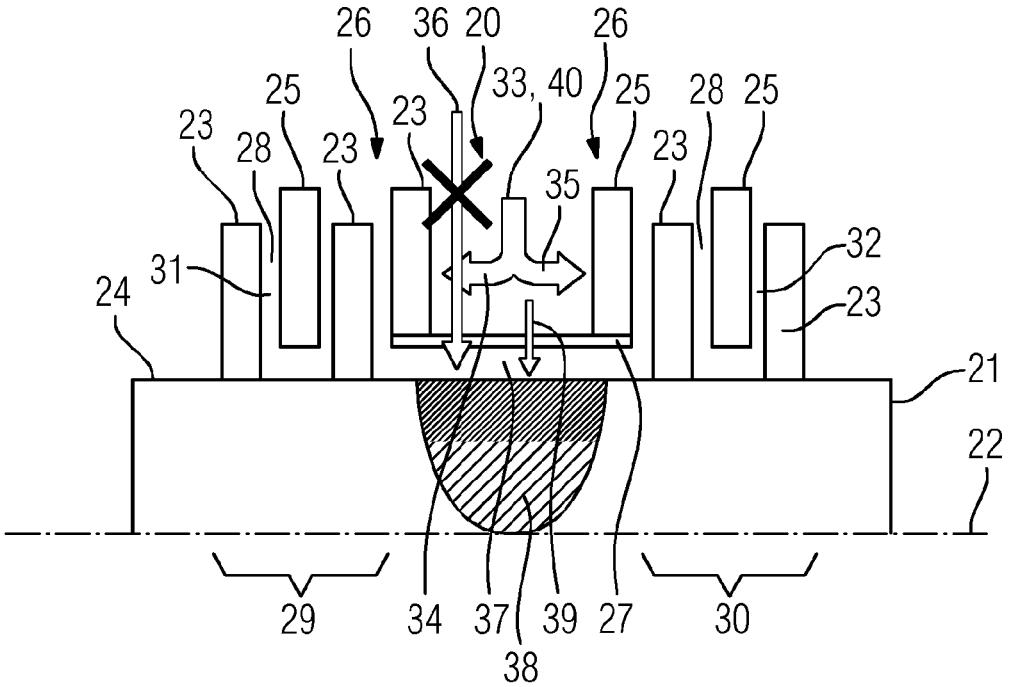
FIG. 3 shows a schematic view of the invention in the event of failure of the cooling medium feed

FIG. 3 shows in the main the same arrangement as in FIG. 2. A repeat of the description and principle of operation of the components is therefore dispensed with. The difference in the view of FIG. 3 lies in the fact that a failure of the cooling medium feed 36 is symbolized by a cross. The failure of the cooling medium feed 36 leads to a heating up of the cooling region 37. This leads to a change of the temperature in the parabolic gray area 38. In FIG. 3, it is to be seen that the shades of gray are darker compared with the gray area in FIG. 2. This means that the temperature is increased compared with the normal operation which is to be seen in FIG. 2. Nevertheless, the temperature difference between the normal operation, as is to be seen in FIG. 2, and the failure operation which is shown in FIG. 3, is moderate. This means that the material of the rotor 21 experiences a comparatively small temperature jump.

Figure 4:
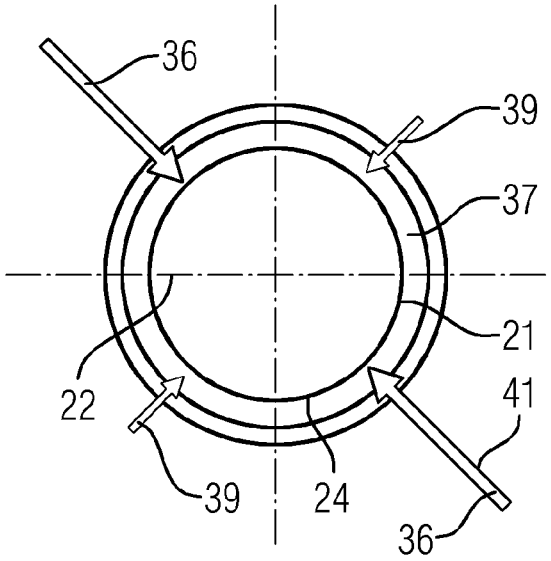
FIG. 4 shows a side view of the arrangement according to the invention

FIG. 4 shows a side view of the arrangement according to the invention. The cooling medium feed 36 in a first embodiment is designed in the radial direction 41 toward the rotational axis. This means that during operation the cooling steam impinges radially upon the rotor 21. Similarly, the line 39 according to FIG. 4 is designed in such a way that during operation steam from the inlet region impinges radially upon the rotor 21.

Figure 5:
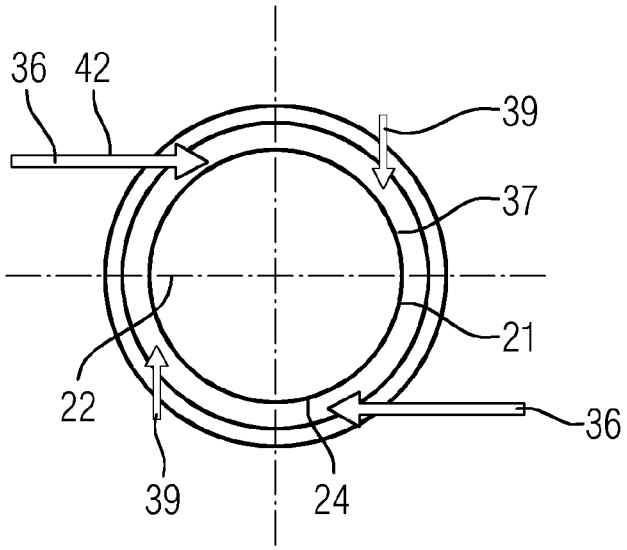
FIG. 5 shows a side view of the arrangement according to the invention in an alternative embodiment.

FIG. 5 shows an alternative embodiment to the embodiment according to FIG. 4. FIG. 5 shows that the cooling medium feed 36 is designed in such a way that during operation the cooling steam impinges tangentially upon the rotor 21. To this end, the cooling medium feed 36 is basically constructed in such a way that the shield has a hole through which the steam can impinge tangentially upon the rotor 21. This leads to a swirl of the steam which is present in the cooling region 37. The line 39 is similarly designed in an alternative embodiment in such a way that during operation steam from the inlet region 20 impinges tangentially upon the rotor 21. This leads to a better mixing in the cooling region 37.

Although the invention has been fully illustrated and described in detail by means of the preferred exemplary embodiment, the invention is not thus limited by the disclosed examples, and other variations can be derived by the person skilled in the art without departing from the extent of protection of the invention.

The invention claimed is:

1. A turbomachine, comprising:

an inlet region for feeding live steam, a rotatably mounted rotor, a casing, which is arranged around the rotor, wherein a flow passage is formed between the rotor and the casing, wherein the flow passage and the inlet region are fluidically interconnected, a shield which is designed in such a way that during operation live steam which flows into the inlet region is deflected into the flow passage, and a cooling medium feed which is designed in such a way that during operation cooling steam from other than the inlet region is directed into a cooling region which is arranged between the shield and the rotor, wherein the shield additionally comprises a line which creates a fluidic connection between the cooling region and the inlet region that is configured to convey live steam from the inlet region into the cooling region and that is discrete from the cooling medium feed.

2. The turbomachine as claimed in claim 1, wherein the turbomachine is of double-flow design.

3. The turbomachine as claimed in claim 2, wherein during operation the live steam which flows into the inlet region is deflected by the shield partly into a first flow and partly into a second flow.

4. The turbomachine as claimed in claim 1, wherein the shield is arranged upstream of a first blade stage.

5. The turbomachine as claimed in claim 1, wherein the shield is arranged around the rotor.

6. The turbomachine as claimed in claim 1, wherein the cooling medium feed is designed in such a way that during operation the cooling steam impinges radially upon the rotor.

7. The turbomachine as claimed in claim 1, wherein the cooling medium feed is designed in such a way that during operation the cooling steam impinges tangentially upon the rotor.

8. The turbomachine as claimed in claim 1, wherein the line is designed in such a way that during operation steam from the inlet region impinges radially upon the rotor.

9. The turbomachine as claimed in claim 1, wherein the line is designed in such a way that during operation steam from the inlet region impinges tangentially upon the rotor.

10. The turbomachine as claimed in claim 1, further comprising:

a cooling medium line which is directly connected to the cooling medium feed, wherein during operation the cooling steam flows in the cooling medium line.

11. A steam power plant comprising a turbomachine as claimed in claim 1, wherein the cooling medium feed is directly connected to a cool reheat line and the cooling steam comprises cool reheat steam.

12. The steam power plant of claim 11, wherein the line is directly connected to a hot reheat line and the live steam comprises hot reheat steam that is hotter than the cooling steam.

13. The turbomachine as claimed in claim 1, wherein the turbomachine is a steam turbine.

* * * * *